United States Patent [19]

Wachter

[11] 4,006,520

[45] Feb. 8, 1977

[54] MACHINE FOR CONNECTING WORKPIECES, ESPECIALLY PIPE BEND SEGMENTS OR THE LIKE

[75] Inventor: Erich Wachter, Zurich, Switzerland

[73] Assignee: Sulzer Brothers Limited, Winterthur, Switzerland

[22] Filed: Jan. 12, 1976

[21] Appl. No.: 648,562

[30] Foreign Application Priority Data

Jan. 20, 1975 Switzerland ..... 647/75

[52] U.S. Cl. ..... 29/243.52; 113/58

[51] Int. Cl.[2] ..... B21D 39/04

[58] Field of Search ..... 29/243.5, 243.52, 243.55; 113/54, 58, 116 UT

[56] References Cited

UNITED STATES PATENTS

| | | | |
|---|---|---|---|
| 1,889,790 | 12/1932 | Perkins | 29/243.52 |
| 2,233,937 | 3/1941 | Hexdall | 29/243.5 |
| 3,435,791 | 4/1969 | Wieters | 113/58 |

*Primary Examiner*—Al Lawrence Smith
*Assistant Examiner*—J. C. Peters
*Attorney, Agent, or Firm*—Werner W. Kleeman

[57] ABSTRACT

A machine for connecting workpieces, especially pipe bend segments or the like comprising a rotatable table for supporting the pipe bend segments which are to be interconnected and a working head having a pair of cooperating rolls for interconnecting contiguous ends of adjacent pipe bend segments, typically at abutting flanges, with one another. Adjustment means permit selectively changing the relative radial spacing between the working head and the rotatable table. Means coact with the rotatable table for elastically supporting the rotatable table in elevational position.

19 Claims, 3 Drawing Figures

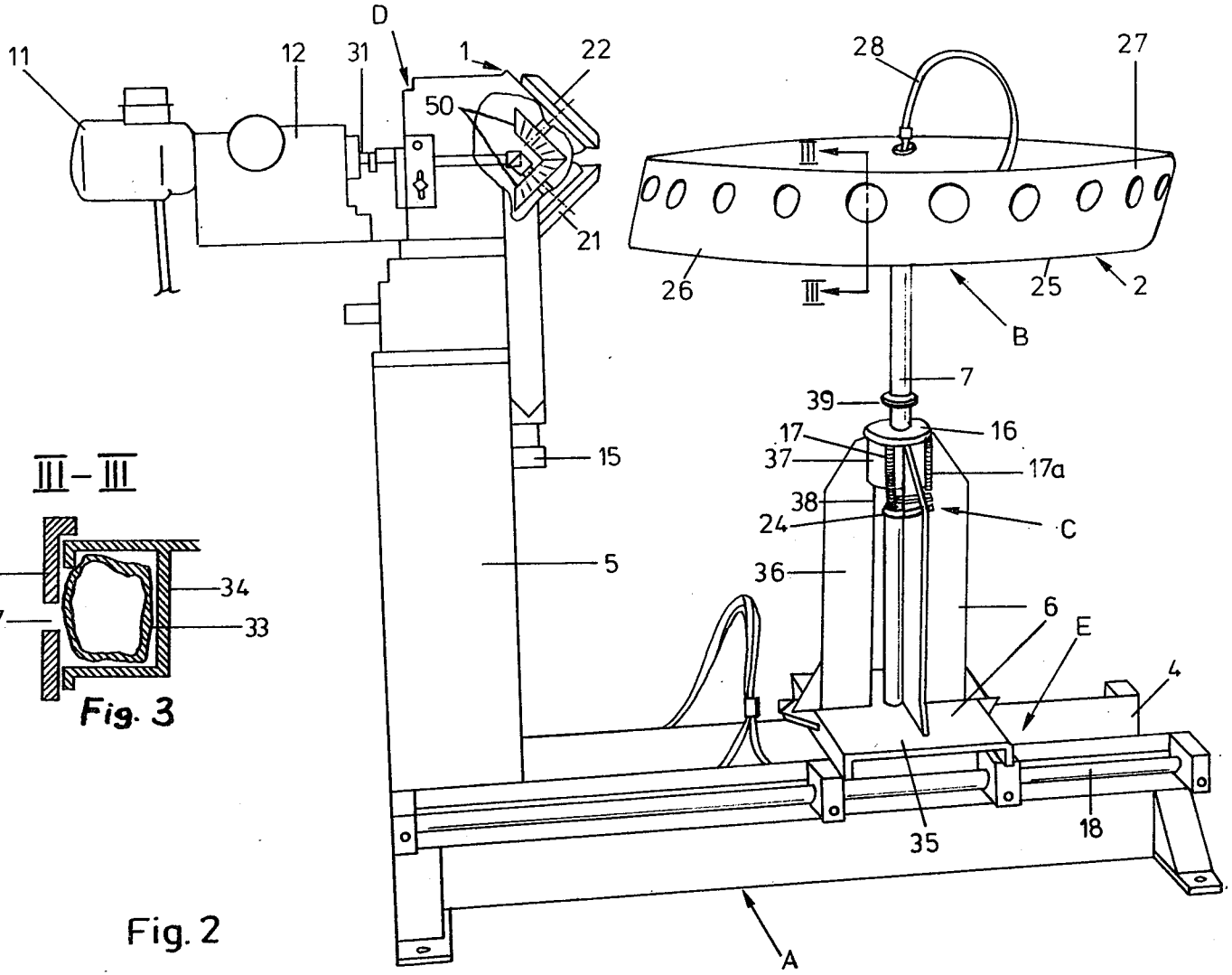
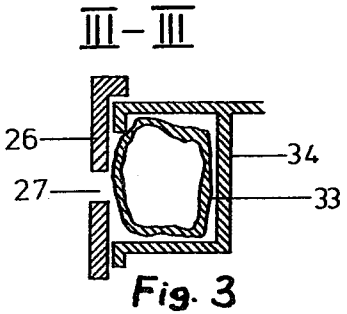
Fig. 3
Fig. 2

MACHINE FOR CONNECTING WORKPIECES, ESPECIALLY PIPE BEND SEGMENTS OR THE LIKE

BACKGROUND OF THE INVENTION

The present invention relates to a new and improved construction of machine for connecting workpieces, especially pipe bend segments or the like with one another.

During the manufacture of pipe bends fabricated from sheet metal or the like and composed of a number of pipe bend segments, it was necessary to manually bend over the connection flanges at the connection seam. Considering the fact that oftentimes pipe bend segments of considerable dimensions had to be handled, the alignment of the pipe bend segments to be interconnected and the bending over of the flanges was both time-consuming and extremely cumbersome. Considerable time and effort was needed to properly position and align the pipe bend segments so that they could be accurately and neatly connected.

SUMMARY OF THE INVENTION

Hence, with the foregoing in mind it is a primary object of the present invention to provide a new and improved construction of machine for connecting pipe bend segments which is not associated with the aforementioned drawbacks and shortcomings.

Another and more specific object of the present invention aims at the provision of a novel machine for connecting pipe bend segments with one another wherein both the preliminary connection work and the main connection work can be accomplished at one and the same machine.

Yet a further object of the present invention aims at the provision of a machine for connecting workpieces, especially pipe bend segments wherein it is possible to simply and rapidly perfect the interconnection of the pipe bend segments.

A further significant object of the present invention relates to a new and improved construction of machine for connecting pipe bend segments with one another in an extremely rapid, positive and reliable manner, requiring very few manual operations and, when needed, such as the preliminary connection work, permitting the same to be carried out at the same machine whereafter there is subsequently carried out the main connection work.

A further object of this invention is directed to the provision of a machine of the character described which is not only relatively simple in construction and design, economical to fabricate, but furthermore extremely easy to use and requires a minimum of maintenance and servicing.

Now in order to implement these and still further objects of the invention, which will become more readily apparent as the description proceeds, the machine of this development is manifested by the features that there is provided a preferably exchangeable rotatable table for supporting the pipe bend segments which are to be connected with one another. Means cooperate with the rotatable table for elastically supporting the same in its elevational position. A work or working head having two rolls for connecting the pipe bend segments, typically at their adjacent confronting flanges, is positioned laterally of the rotatable table, the working head being supported at an upright or support. Adjustment means enable selectively varying the relative radial spacing between the working head and the rotatable table.

The rotatable table is advantageously provided with an expansible bellows which is fed with a suitable fluid medium, typically compressed air. In this way the pipe bend segment to be connected can be positively clamped in a position where the connecting rolls can act thereon and upon the other pipe bend segment to be connected therewith. Undesired shifting of the thus clamped pipe bend segment is positively avoided, permitting accurate and easy connection of the pipe bend segments with one another. At least one of the connecting rolls may be positively driven by a suitable drive, although it is possible to drive both such rolls. It is even conceivable to simply have both of the connecting rolls mounted to be freely rotatable and to positively drive the rotatable table, although it is prefered to provide an arrangement wherein at least one of the connecting rolls is positively driven.

The means for elastically supporting the rotatable table in its elevational position advantageously allows for compensating the weight acting upon the rotatable table due to the pipe bend segments carried thereby so that the rotatable table always assumes an approximately similar position with respect to the working head and the connecting rolls thereof. By the same token the elastic supporting means permits adaptation of the system to different size rotatable tables. The elastic supporting means for the rotatable table may be constituted by resilient elements in the form of springs or a fluid operated cylinder unit, by way of example.

Continuing, mechanism may also be provided for laterally shifting the rotatable table with respect to the working head. Such mechanism may comprise a carriage movable upon guide rails, rods or the like, or the carriage can be translated by a driven screw, for instance operated by an electric motor.

With the construction of machine of this development it is possible to produce good sturdy connections at pipe bend segments, even then when the pipe bend is assembled together from a number of segments or the axis of the pipe bend is located in more than one plane. Additionally, with very little reset-up work it is possible to process pipe bend segments of different diameter.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 2 is a perspective view of the machine illustrated in FIG. 1, but without the pipe bend segments, to reveal further structure thereof; and FIG. 3 is a cross-sectional view taken substantially along the line III—III of FIG. 2.

DETAILED DESCRIPTION OF THE PREFERRED EMBODIMENTS

Figure 1:
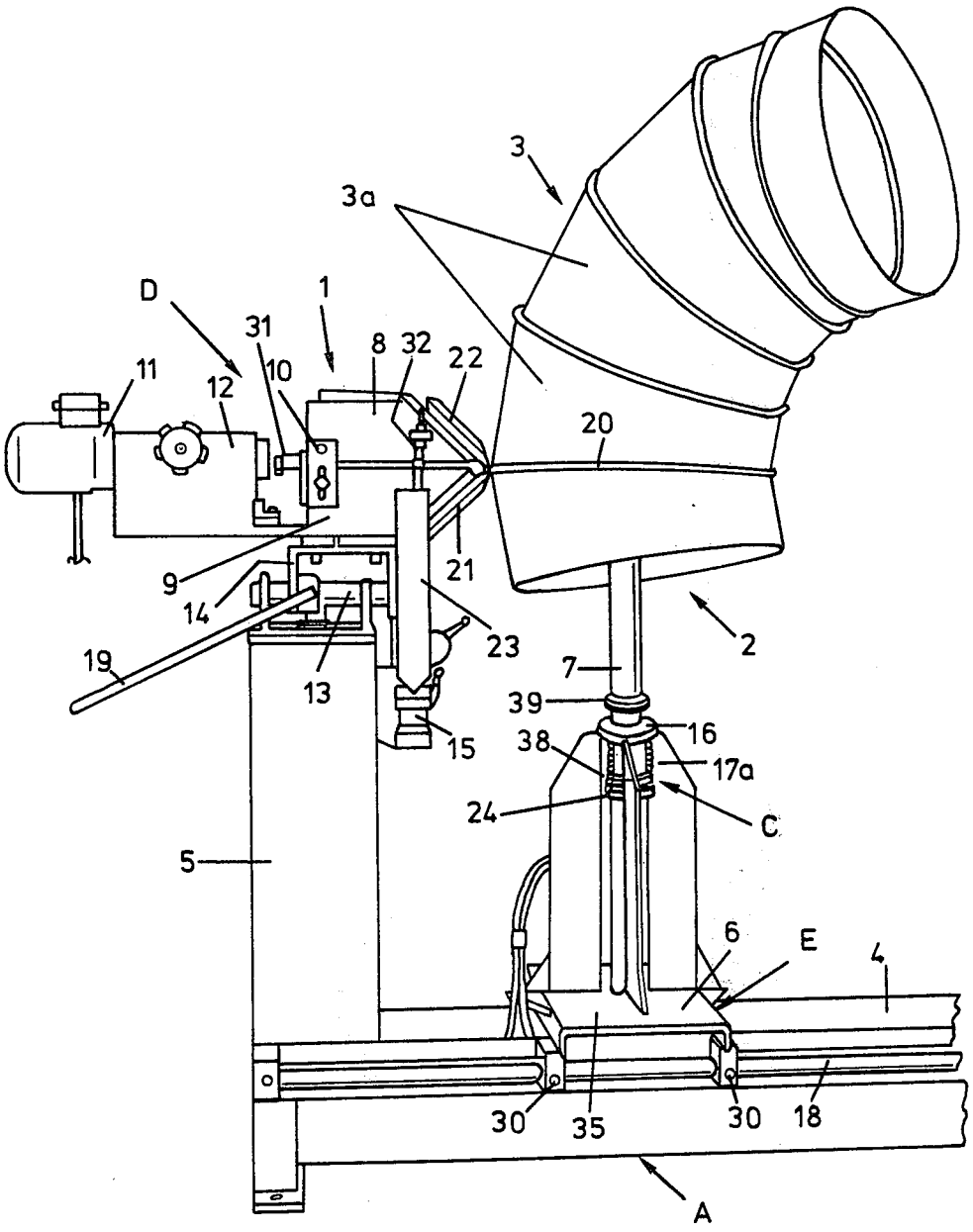
FIG. 1 is a perspective view of a machine constructed according to the present invention for connecting pipe bend segments with one another.

Generally speaking, the machine of this development serves for connecting workpieces, especially individual pipe bend segments 3*a* at their connection seams 20 to form a pipe bend, generally designed by reference character 3. Pipe bend segments 3*a* can be formed of any suitable material, such as sheet metal, for instance chromium, copper or steel sheet or plastic. Typically the opposed ends of each pipe bend segment are provided with appropriately formed flanges which are connected with the aid of the machine of this invention with the confronting flange of each neighboring pipe bend segment, for instance by folding or bending, welding or heat sealing, as will be discussed more fully hereinafter. The flanges at opposite ends of any pipe bend segment may be of the same configuration or differently configured.

Turning attention now to the exemplary embodiment of machine portrayed in FIGS. 1 to 3, it will be recognized that the same generally comprises a machine frame unit A carrying a clamping unit B which is supported by a shaft 7 cooperating with a load compensation unit or device, generally indicated by reference character C. Further, the machine frame unit A supports a working unit D for forming the connection at the pipe bend segments carried by the clamping unit B. Moreover, a movable support device E is provided for the clamping unit B and is displaceably mounted at the machine frame unit A to permit the clamping unit B and working unit D to be selectively adjustably positioned relative to one another, as will be explained more fully hereinafter.

The clamping unit B serves for the clamping and supporting of the workpieces, in this case the pipe bend segments 3*a* which are to be interconnected and comprises a rotatable table 2. This rotatable table 2 embodies a clamping member 25 for clamping the lowermost pipe bend segment 3*a* which is to be connected, clamping member 25 being seated upon vertically extending rotatable shaft 7 forming an axis of rotation for the rotatable table 2. The clamping member 25 functioning so-to-speak as a workpiece chuck for the pipe bend segments 3*a* clamped thereby is substantially the same size as the inner diameter of the pipe bend segments which are being processed, and therefore, it is advantageous to construct the clamping member 25 to be exchangeable by conveniently detachably securing the same to the shaft 7, so that it is possible to mount a different size clamping member in order to easily convert the machine for connecting correspondingly different size pipe bend segments.

Continuing, the machine frame unit A will be seen to comprise a base 4 at which there is displaceably guided a carriage 6 of the movable support device E. The rotatable shaft 7 is elastically supported in carriage 6 by the load compensation unit C as will be discussed hereinafter. Carriage 6 is displaceable along two essentially parallel horizontal guide rail means, here shown in the form of guide rods or bars 18, only one of which is visible in the showing of the drawings. Furthermore, this carriage 6 can be fixed in desired position by any suitable fixing means, generally indicated by reference character 30, for instance screws, clamps, or other suitable arresting means. The guide rods 18 are mounted in the base 4, which extends substantially horizontally. Of course, the manner in which the carriage is shifted relative to the machine frame unit A is not crucial and other systems could be utilized. For instance, carriage 6 could be displaced by a screw driven by any suitable drive motor, such as an electric motor.

The base 4 has rigidly connected therewith a vertical support or stand 5 which carries the working unit or device D. This working unit D embodies a working head 1 equipped with rotatable rolls 21, 22 for forming the connection of contiguous flanges of adjacent pipe bend segments, whether such be by folding, welding or heat sealing. The working head 1 is therefore located at the region of the work table 2 and will be seen to comprise an upper roll support 8 and a lower roll support 9, these supports 8 and 9 being mounted so as to be relatively pivotable with respect to one another within limits, for instance by mounting the upper roll support 8 to be pivotable about the pivot shaft 10, so that both of the connecting rolls 21, 22 can be spaced at a greater or lesser distance from one another, as desired, in order to engage with the flanges of the pipe bend segments to be connected. These connecting rolls 21, 22 are constructed such that when they assume their pipe bend segment-connecting position, as viewed in essentially axial section, they have two approximately parallel extending work surfaces between which there nests the contiguous flanges of the pipe bend segments which are in the process of being interconnected. Further, pivot shaft 10 is arranged at the ends of the roll supports 8, 9 which face away from the connecting rolls 21, 22.

The rotatable connecting rolls 21, 22 may either each be driven or only one of them driven. Any suitable mechanism can be utilized for driving one or both of the rolls 21, 22. In the embodiment under consideration both of the rolls 21, 22 are driven and this takes place by means of an electric motor 11 which is operatively connected with a gear mechanism, for instance bevel gearing 12. From this location the power transmission occurs via a shaft 31 to conventional meshing bevel gears located internally of the roll supports 8, 9 and schematically indicated in the showing of FIG. 1 by reference character 50. While it is advantageous to drive at least one of the connecting rolls 21, 22 it would be possible to positively drive the work table 2 and merely have the connecting rolls 21, 22 entrainably driven due to the frictional contact with the pipe bend segments.

At the lower end of brackets or supports 23 rigidly connected with the lower roll support 9 there is secured a fluid-operated lifting cylinder 15, for instance a pneumatically operated lifting cylinder, which with the aid of rods 32 or the like can downwardly retract the upper roll support 8 when compressed air or other suitable pressurized fluid medium is supplied to the associated lifting cylinder 12 functioning as a clamping cylinder for the contacting flanges of the pipe bend segments to be connected. Due to the pivotal mounting of one of the roll supports, in this case the roll support 8, the working unit D and specifically the connecting rolls 21, 22 can have the spacing therebetween varied to accommodate different flange thicknesses.

The working head 1 together with the drive units 11, 12 are essentially horizontally movably arranged upon two substantially horizontally spaced support columns or posts 13, one of which is visible in FIG. 1. Upon these support columns 13 there is adjustably mounted a substantially U-shaped carrier or support 14 which can be forwardly advanced or retracted with the aid of a manually-operated lever 19 or other suitable operating structure. Hence, it should be apparent that the working head 1 together with the connecting rolls 21, 22 can be horizontally shifted towards and away from the work table 2. This adjustment feature is beneficially provided for distance compensation purposes, in particular because the connection seam inherently does not have the shape of a circle rather an oval configuration. Thus, by operating the manual lever 19 both of the connecting rolls 21, 22 always can be adjusted with regard to the connection seam and it is possible to compensate for radial distance changes arising at the flanges to be connected during rotation of the rotatable table 2 due to the aforementioned oval configuration of the pipe bend segments. As best seen by referring to FIGS. 2 and 3, for the temporary clamping of the lower pipe bend segment the clamping member 25 is provided at its periphery with an expansible hose-like bellows 33 formed of an elastic material. Bellows 33 radially bears at the inside of the clamping member 25 upon a ring member 34 and the infeed of the pressurized fluid medium, typically compressed air, takes place by means of a hose or conduit 28 leading through the hollow rotatable shaft 7. At the periphery of the jacket 26 of the clamping member 25 there are provided a multiplicity of spaced openings or holes 27 through which the bellows 33 can bear against the pipe bend segment which has been mounted upon the rotatable table 2 embodying the clamping member 25. The jacket or outer surface 26 of clamping member 25 —related to the rotatable shaft 7— forms an oblique-angled cylinder i.e. jacket 26 is constituted as an inclined jacket surface.

The rotatable shaft 7 piercingly extends at its lower end through a top plate 35 of the carriage 6 providing a first bearing or support location for the rotatable shaft 7. The top plate 35 of the carriage 6 further carries a number of spaced upstanding struts or webs 36 at which there is secured a sleeve or bushing 37 defining a second bearing location for shaft 7. The load compensation unit or device C, in the embodiment under discussion, may comprise a plate 16 which can be secured to the upper ends of the upstanding struts or webs 36 and at which plate there is suspended one end of resilient elements, such as the tension springs 17, the other ends of which are suspended at a plate 24 loosely seated on shaft 7. Above the plate 24 there is arranged an adjustable ring 38 which is mounted upon the shaft 7 and axially movable therealong to define a first limit stop for limiting the upward movement of shaft 7. Above the plate 16 there is mounted upon the shaft 7 for adjustment axially thereof a second ring 39 defining a second limit stop for limiting the downward displacement of the shaft 7 which is held so-to-speak in a floating state.

Now if the shaft 7 carries a larger size clamping member 25 then the greater weight would tend to move such clamping member downwardly out of the desired working plane of the connecting rolls 21, 22, but this can be compensated by connecting further ones of the tension springs 17 which then tend to urge the shaft 7 upwardly back into its proper working position at the effective zone of the connecting rolls 21, 22. By the same token if a smaller clamping member 25 is exchangeably mounted upon the shaft 7, for instance so as to bear upon a shoulder thereof, then one or more of the springs 17, such as has been illustrated for the spring 17a in the showing of the drawings, can be disconnected. Obviously the same result can be achieved by replacing the springs for heavier or lighter springs, as needed. Equally, during the formation of the pipe bend as more and more pipe bend segments are being carried by the work table 2 the increasing load or weight can be compensated by connecting further springs to the plate 24. Moreover, the floating arrangement of the shaft 7 insures that the connecting rolls 21, 22 during the connection operation do not bind when the connection seam is not exactly located in the working plane since the work table or rotatable table 2 can shift in axial direction. The adjustable rings 38 and 39 can be selectively positioned along the shaft 7 to limit the axial movement of shaft 7 and thereby the work table 2. The elastic mounting of the work table 2 need not be accomplished by the just discussed spring system inasmuch as other devices suitable for this purpose could be beneficially employed, for instance by providing a fluid-operated cylinder unit which could be supplied with a pneumatic or hydraulic fluid medium for the stated purposes.

Having now had the benefit of the foregoing discussion of the machine of this development, its mode of operation will be described and is as follows:

By way of illustration there will be considered the connection of pipe bend segments **3*a* to one another by carrying out a folding or bending operation, although it is to be expressly understood that the machine of the invention is in no way limited just to such type operation. For purposes of discussion it may be assumed that each pipe bend segment has at one end a radially extending flange and at its other end a radially extending flange with which merges an axially extending web, this web being intended to be crimped or bent over the radially extending flange of the next adjacent overlying pipe bend segment. Hence, initially there is placed upon the rotatable shaft 7 a clamping member 25 which corresponds to the diameter of the pipe bend segments 3*a* to be connected. Thereafter the carriage 6 is shifted along the guide rods 18 or other suitable structure, such as the previously mentioned power driven screw, such that there remains a small intermediate space between the working head 1 and the clamping member 25. Then a lower pipe bend segment 3*a* is mounted upon the clamping member 25 such that its upper connection edge containing the flange provided with the web is located approximately in a horizontal plane. While in this position such pipe bend segment 3*a* is fixedly clamped or chucked by the infeed of compressed air to the bellows 33 in that portions of such bellows penetrate through the openings or holes 27 against the inner surface of the pipe bend segment and thus fixedly but releasably clamp the same at the clamping member 25. Thereafter a second pipe bend segment is placed upon the first pipe bend segment such that its end having the radially extending flange bears against the flange of the clamped pipe bend segment and these flanges are preliminarily secured manually at their periphery, something which can be accomplished quite easily by bending over at given locations portions of the flange web with a plier or other suitable tool. By connecting further springs or disconnecting certain of the springs 17, as required, and, if necessary, by adjusting the rings 38 and 39 along the shaft 7 there can be carried out an accommodation of the elevational position of the clamping member 25 in a manner that the connection seam 20 practically is located essentially at the height of the gap between both of the connecting rolls 21, 22. These connecting rolls 21, 22 are then placed into rotation and the working head 1 is advanced with the aid of the manually operated lever 19 to such an extent that the connecting rolls 21, 22 come to lie at the region below and above the abutting flange edges. Thereafter, the lifting cylinder 15 is supplied with compressed air so that the upper connecting roll 22 is lowered and then both of the connecting rolls 21, 22 contactingly press against the flange edges and with progressive rotational movement from the connection seam 20. Due to the clamping action exerted by the connecting rolls 21, 22 upon the abutting flanges of the two pipe bend segments to be interconnected the pipe bend segments are turned upon the rotatable table 2 so that the entire peripheral extent of the flanges comes into operable zone of the connecting rolls 21, 22 whereby a firm connection is established between the flanges and thus the pipe bend segments. When using the rolls 21, 22** as bending or folding rolls the same may be formed for instance of steel.

As mentioned above, it is however not necessary that the connecting rolls 21, 22 be used for providing a fold connection, they could be equally employed for welding or heat sealing the flanges or otherwise to one another. Thus, for instance, when the pipe bend segments are formed of chromium or copper it is advantageous to provide the connecting rolls 21, 22 as welding rolls to which welding current can be conventionally supplied. These rolls then may be advantageously formed as copper rolls. When working with plastic pipe bend segments the rolls 21, 22 may be simply heated for heat sealing or welding the ends of the plastic pipe bend segments to one another. Heating of these rolls 21, 22 would be possible by furnishing the same with a heated fluid medium or by electrically heating the rolls. When electrically heating the same copper rolls are preferred, and when using a heated fluid medium for heating the rolls there can be used either steel or copper rolls for instance.

Further, it is possible to arrange at least one preforming roll in front of both of the connecting rolls 21, 22.

While there is shown and described present preferred embodiments of the invention, it is to be distinctly understood that the invention is not limited thereto, but may be otherwise variously embodied and practiced within the scope of the following claims.

What is claimed is:

1. A machine for connecting pipe bend segments, comprising a table for supporting pipe bend segments to be interconnected, means for rotatably mounting the table, a support, a working head mounted at said support for cooperation with said rotatable table, said working head being provided with two rolls for connecting the pipe bend segments, adjustment means for changing the relative spacing between the working head and the rotatable table, and means for elastically supporting the rotatable table in elevational position.

2. The machine as defined in claim 1, further including drive means for driving at least one of said working rolls.

3. The machine as defined in claim 2, wherein said rotatable table includes clamping means having an inclined jacket surface, and fluid-operated means for releasably holding a pipe bend segment which is to be connected at its inner surface.

4. The machine as defined in claim 3, wherein said holding means comprises an expansible bellows extending along the jacket surface of the clamping means.

5. The machine as defined in claim 4, wherein said jacket surface is provided with opening means, said expansible bellows at least partially protruding through said opening means for contact with a pipe bend segment mounted upon the rotatable table for releasably clamping such pipe bend segment.

6. The machine as defined in claim 1, further including a base for supporting the rotatable table, means for supporting the rotatable table to be displaceable upon said base, and means for displacing the rotatable table upon said base by means of said supporting means towards and away from said working head.

7. The machine as defined in claim 6, further including means for fixing the position of the rotatable table at said base.

8. The machine as defined in claim 6, wherein said adjustment means for changing the relative spacing between the working head and the rotatable table includes manually operated means for adjusting the working head relative to said table during such time as said rolls are performing a connection operation at two pipe bend segments to be interconnected.

9. The machine as defined in claim 8, wherein said manually operated means includes at least one lever for adjusting the working head radially with respect to said rotatable table.

10. The machine as defined in claim 1, wherein said working head comprises a support, means for pivotably mounting said support, one of said rolls being carried by said pivotable support.

11. The machine as defined in claim 10, further including means for urging said one roll towards the other roll.

12. The machine as defined in claim 1, wherein said means for rotatably mounting the table comprises a shaft, bearing means for rotatably mounting said shaft while permitting axial displacement thereof, said elastically supporting means comprising structure acting upon said shaft in a manner to permit compensation of different loads applied to the shaft in order to maintain the rotatable table at a substantially predetermined elevational position with respect to the working head.

13. The machine as defined in claim 1, wherein said means for rotatably mounting the table includes a rotatably mounted shaft, said rotatable table being exchangeably supported by said rotatably mounted shaft.

14. A machine for connecting workpieces, comprising a table for supporting the workpieces to be connected, means for rotatably mounting the table, working head means for rotatably supporting a pair of connecting rolls for connecting two workpieces with one another when supported by said rotatable table, means for supporting the working head means in a position for coaction of said connecting rolls with the workpieces supported at said rotatable table, means for changing the spacing between the connecting rolls and said rotatable table during operation of said connecting rolls, and means for adjustably supporting the rotatable table in elevational position in order to maintain the rotatable table substantially at a predetermined elevational position with respect to the connecting rolls.

15. The machine as defined in claim 14, wherein said changing means comprises mechanism for displacing the connecting rolls relative to the rotatable table.

16. The machine as defined in claim 14, wherein said changing means includes mechanism for displacing the rotatable table relative to said working head means.

17. The machine as defined in claim 14, further including means for driving at least one of said connecting rolls.

18. The machine as defined in claim 14, further including means for displaceably supporting at least one of said connecting rolls.

19. A machine for connecting workpieces, comprising means for supporting workpieces to be connected, means for rotatably mounting the workpiece supporting means, connecting means for connecting two workpieces with one another when supported by said workpiece supporting means, means for supporting the connecting means in a position for coaction with the workpieces supported at said workpiece supporting means, means for changing the spacing between the connecting means and said workpiece supporting means, means for imparting relative movement between said workpiece supporting means and said connecting means, and means for adjustably supporting the workpiece supporting means in elevational position in order to maintain the workpiece supporting means substantially at a predetermined elevational position with respect to the connecting means.

* * * * *